United States Patent [19]

Blanchard

[11] 4,354,847

[45] Oct. 19, 1982

[54] HIGH TILT PIVOT MOUNTING ARRANGEMENT FOR AN OUTBOARD MOTOR

[75] Inventor: Clarence E. Blanchard, Kenosha, Wis.

[73] Assignee: Outboard Marine Corporation, Waukegan, Ill.

[21] Appl. No.: 167,338

[22] Filed: Jul. 9, 1980

[51] Int. Cl.[3] ..... B63H 21/26

[52] U.S. Cl. ..... 440/61; 440/900

[58] Field of Search ..... 440/53, 55, 56, 57, 440/61, 62, 63, 900; 248/640, 641, 642, 643

[56] References Cited

U.S. PATENT DOCUMENTS

| | | | |
|---|---|---|---|
| 3,269,351 | 8/1966 | Shimanckas | 440/61 |
| 3,468,282 | 9/1969 | Wintercorn | 440/61 |
| 3,486,724 | 12/1969 | Adamski | 440/61 |
| 3,688,733 | 9/1972 | Blanchard | 440/61 |
| 4,099,479 | 7/1978 | Arimitsu | 440/63 |

*Primary Examiner*—Trygve M. Blix
*Assistant Examiner*—Jesús D. Sotelo
*Attorney, Agent, or Firm*—Michael, Best & Friedrich

[57] ABSTRACT

Disclosed herein is a marine propulsion device comprising a transom bracket adapted to be fixed to a boat transom, a swivel bracket including a vertical leg having upper and lower ends, and a pair of arms extending upwardly in laterally spaced relation from the upper end of the swivel bracket vertical leg and including respective upper ends, a first pivot connecting the upper ends of the arms and the transom bracket for vertical swinging of the swivel bracket relative to the transom bracket about a first axis which is horizontal when the transom bracket is boat mounted, a propulsion unit including a powerhead and a lower unit fixedly connected to said powerhead and including, at the lower end thereof, a propeller, and a second pivot connecting the propulsion unit and the swivel bracket vertical leg for movement of the propulsion unit in common with the swivel bracket about the first axis and for steering movement of the propulsion unit relative to the swivel bracket about an axis which extends transversly to the first axis.

25 Claims, 2 Drawing Figures

HIGH TILT PIVOT MOUNTING ARRANGEMENT FOR AN OUTBOARD MOTOR

RELATED APPLICATION

Attention is directed to the co-pending Myron T. Stevens application entitled "Outboard Motor With Elevated Horizontal Pivot Axis", Ser. No. 159,480, filed June 16, 1980.

Attention is also directed to my co-pending Ser. No. 167,337, filed July 9, 1980, and entitled Outboard Motor With Dual Trim and Tilt Axes.

BACKGROUND OF THE INVENTION

The invention relates generally to marine propulsion devices and, more particularly, to outboard motors comprising a propulsion unit which includes a powerhead and a propeller carrying lower unit and which is both tiltable and steerable relative to the boat transom on which the outboard motor is mounted.

Still more particularly, the invention relates to arrangements for boat mounting an outboard motor propulsion unit for vertical tilting and horizontal steering movements such that upward tilting of the propulsion unit to a raised or elevated position providing accessibility to the propeller above the water does not involve movement of the propulsion unit forwardly of the rear surface of the transom. With such mountings, the inside area of a boat is effectively increased and the common transom cutout or notch can be avoided with the result that a higher transom can be employed to obtain greater seaworthiness.

Attention is directed to the Stevens application Ser. No. 159,480, filed June 16, 1980, and entitled "Outboard Motor With Elevated Horizontal Pivot Axis".

Attention is also directed to my co-pending application Ser. No. 167,337, filed July 9, 1980, and entitled "Outboard Motor with Dual Trim and Tilt Axes".

Attention is also directed to the Shimanckas U.S. Pat. No. 3,269,351, issued Aug. 30, 1966 and to the Pichl U.S. Pat. No. 4,177,747 issued Dec. 11, 1979.

SUMMARY OF THE INVENTION

The invention provides a marine propulsion device comprising transom bracket means adapted to be fixed to a boat transom, a swivel bracket including a vertical leg having upper and lower ends, and a pair of arms extending upwardly in laterally spaced relation from the upper end of the swivel bracket vertical leg and including respective upper ends, first pivot means connecting the upper ends of the arms and the transom bracket means for vertical swinging of the swivel bracket relative to the transom bracket means about a first axis which is horizontal when the transom bracket means is boat mounted, a propulsion unit including a powerhead and a lower unit fixedly connected to the powerhead and including, at the lower end thereof, a propeller, and second pivot means connecting the propulsion unit and the swivel bracket vertical leg for movement of the propulsion unit in common with the swivel bracket about the first axis and for steering movement of the propulsion unit relative to the swivel bracket about an axis which extends transversely to the first axis.

In one embodiment of the invention, the marine propulsion device further includes means connected to the transom bracket means and to the lower end of the swivel bracket for selectively displacing the swivel bracket about the first axis. Such means can comprise a hydraulic cylinder-piston assembly extending principally horizontally when the swivel bracket and propulsion unit are in normal operating position and transmitting propulsive thrust to the boat transom.

In one embodiment of the invention, the marine propulsion device further include means on the transom bracket means and on the lower end of the swivel bracket for providing lateral support thereto under side loading while permitting unrestrained pivotal movement of the swivel bracket about the first axis in the absence of side loading.

In one embodiment of the invention, the means for providing lateral support comprises a laterally spaced pair of rearwardly extending legs positioned to receive therebetween the swivel bracket lower end.

In one embodiment of the invention, the powerhead includes a top and the horizontal axis is located adjacent to or above the top of the powerhead.

In one embodiment of the invention, the second pivot means connects the vertical leg of the swivel bracket and the drive shaft housing.

In one embodiment of the invention, the powerhead extends between the arms of the swivel bracket.

In one embodiment of the invention, the propulsion unit is located, when in a fully tilted position, wholly rearwardly of the boat transom.

Other features and advantages of the embodiments of the invention will become known by reference to the following general description, claims and appended drawings.

IN THE DRAWINGS

Figure 1:
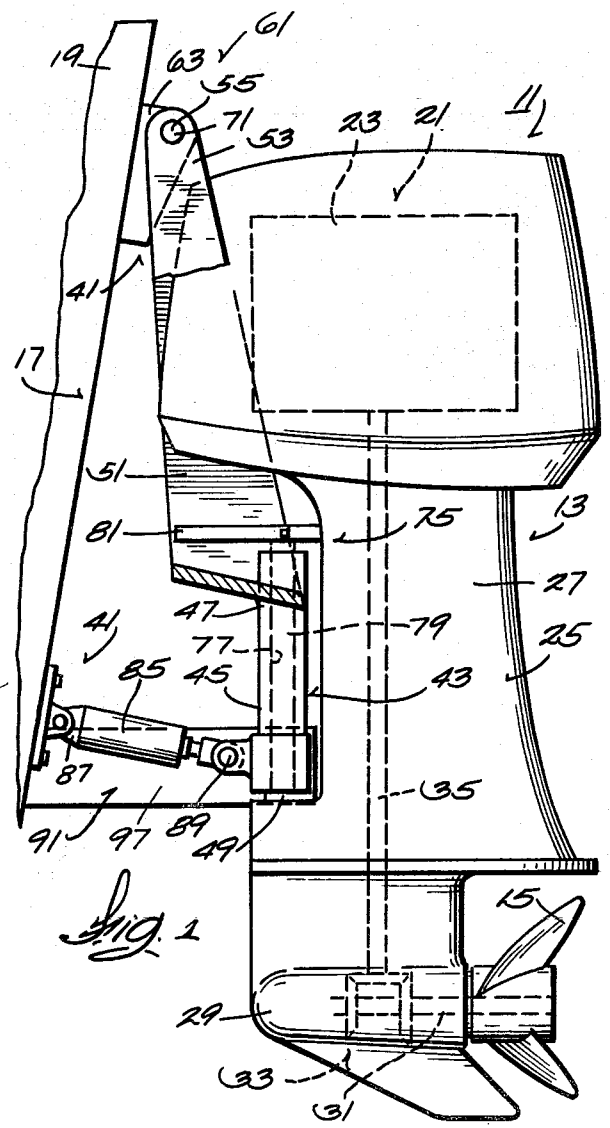
FIG. 1 is a side elevational view, partially broken away and in section, of an outboard motor embodying various of the features of the invention.
Figure 2:
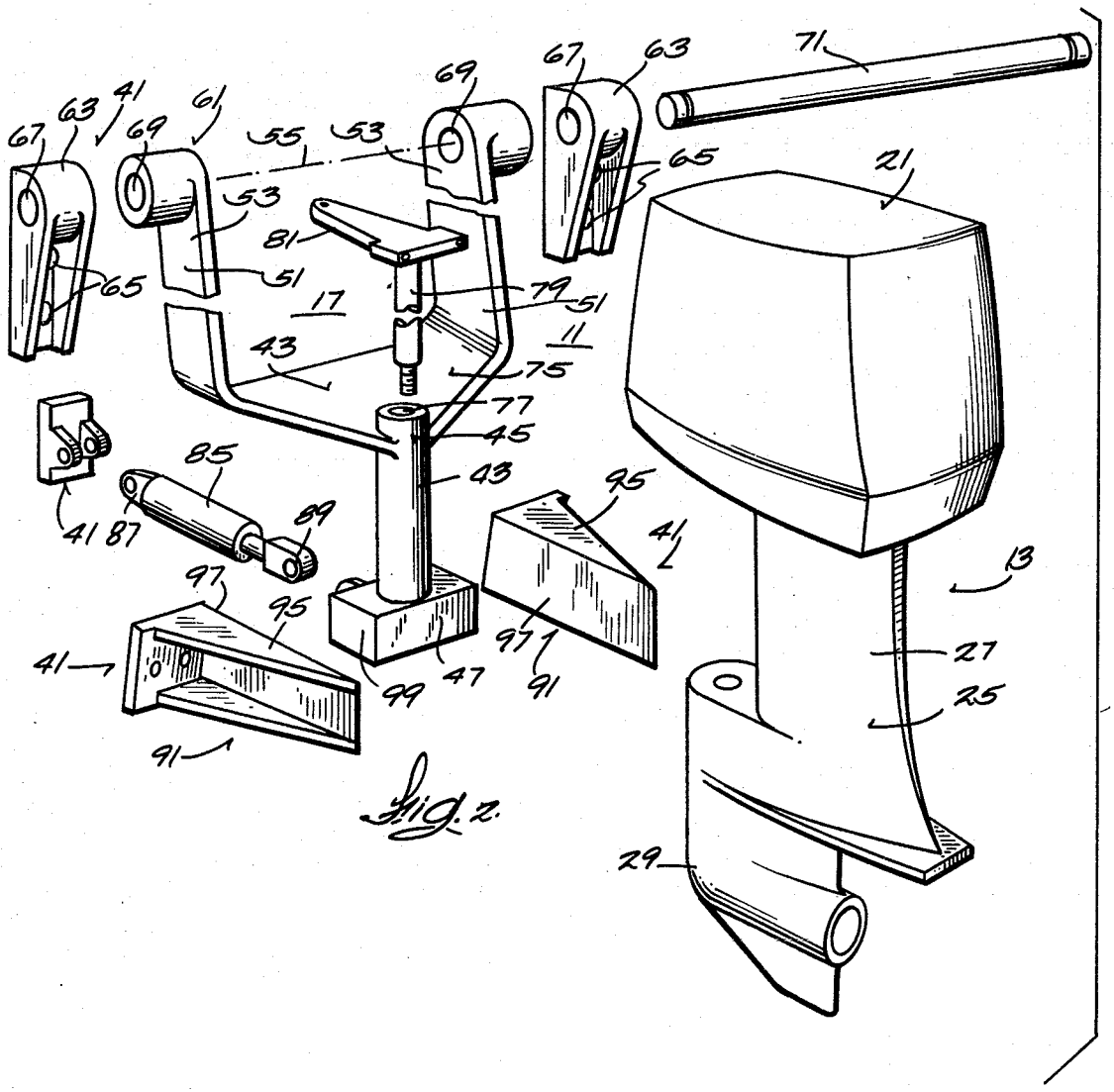
FIG. 2 is a schematic exploded view of the outboard motor shown in FIG. 1.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device in the form of an outboard motor 11 comprising a tiltable and steerable propulsion unit 13 including a rotatably mounted propeller 15. The outboard motor 11 also includes means 17 for mounting the propulsion unit 13 on a boat transom 19 so as, as will be explained more fully hereinafter, to permit tilting of the propulsion unit 13 from a normal running position to a raised tilted position providing above water accessibility to the propeller 15 without causing any substantial movement of the propulsion unit 13 forwardly of the rear of the boat transom 19.

As is conventional, the propulsion unit 13 includes a powerhead 21 provided with an internal combustion engine 23, together with a lower unit 25 which is fixed to the bottom of the powerhead 21 and which includes a drive shaft housing 27 and a lower gear case or box 29 which is fixed to the bottom of the drive shaft housing 27 and which supports a propeller shaft 31 carrying the propeller 15. The gear box 29 includes a suitable transmission 33 which connects the propeller shaft 31 to a drive shaft 35 which extends in the drive shaft housing 27 and in turn, is connected to the crankshaft (not shown) of the internal combustion engine 23.

The means 17 for mounting the propulsion unit 13 for vertical tilting and horizontal steering movements comprises transom bracket means 41 which is adapted to be fixed to the boat transom 19 and which can constitute a unitary member, or an assemly of members, or separate pieces individually fixed to the rear surface of the boat transom 19 by any suitable means.

The means 17 for tiltably and steerably mounting the propulsion unit 13 further includes a swivel bracket 43 having a lower, generally vertically extending leg 45 with upper and lower ends 47 and 49, respectively, together with a pair of laterally spaced arms 51 which extend upwardly from the upper end 47 of the swivel bracket vertical leg 45 and which in turn, include upper ends 53.

The means 17 for tiltably and steerably mounting the propulsion unit 13 further includes first pivot means 61 located behind the boat transom 19 and connecting the upper ends 53 of the swivel bracket arms 51 to the transom bracket means 41 for pivotal movement of the swivel bracket 43 about an axis 55 which is horizontal when the transom bracket means 41 is boat mounted. While various arrangements can be employed, in the illustrated instruction, such means includes fabrication of the transom bracket means 41 with a pair of laterally spaced brackets 63 located outwardly of the upper ends 53 of the arms 51 and suitably fixed to the transom as by bolts 65, together with respective aligned, horizontal bores 69 in the upper ends 53 of the swivel bracket arms 51, aligned horizontal apertures 67 in the brackets 63, and a tilt pin 71 extending through adjacent apertures and bores and suitably fixed against displacement. If desired, a suitable horizontally extending enlargement (not shown) which includes a horizontal bore adapted to receive the tilt pin 71 and which is located between the arms 51, could be employed although it is preferred to leave open the space between the upper ends 53 of the arms 51.

The means 17 for tiltably and steerably mounting the propulsion unit 13 further includes a second pivot means 75 for pivotally connecting the propulsion unit 13 to the vertical leg 45 of the swivel bracket 43. While various arrangements can be employed, in the illustrated construction, such means comprises formation of the vertical swivel bracket leg 45 with a vertically extending bore 77 receiving a king pin 79 having, at its upper and lower ends beyond the bore 77, suitable means which are suitably fixed to the drive shaft housing 27 so as to provide for common pivotal steering movement of the king pin 79 and propulsion unit 13 relative to the swivel bracket 43. Such means are common in the outboard motor field and need not be further described.

Extending fixedly from the upper end of the king pin 79 is a steering arm 81 to which any suitable steering mechanism (not shown) can be connected.

As shown in the drawings, when the propulsion unit 13 is connected to the swivel bracket 45, the swivel bracket arms 51 extend upwardly a distance sufficient that the upper or tilt axis 55 is generally at a level adjacent or above the top of the powerhead 21. As a consequence, the propulsion unit 13 can be swung upwardly to its fully raised position, while wholly retaining the powerhead 21 aft or behind of the boat transom 19. It is also noted that the powerhead 21 extends, in part, between the arms 51 of the swivel bracket 43.

The outboard motor 11 also includes means for vertically tilting the swivel bracket 43 and connected propulsion unit 13 about the horizontal axis 55 between a normal operating position shown in FIG. 1 and a raised position (not shown) affording above water accessibility to the propeller 17. While various arrangements can be employed, in the illustrated construction, such means comprises a hydraulic cylinder-piston assembly 85 including a pair of opposed eyes 87 and 89. One of the eyes 87 is pivotally connected, by any suitable means, to the transom bracket means 41 and the other eye 89 is pivotally connected, by any suitable means, to the lower end 49 of the swivel bracket vertical leg 45. When the propulsion unit 13 is in the normal operating position, the cylinder-piston assembly 85 preferably extends generally horizontally. Transmission of propulsive thrust is principally directed to the transom 19 through the cylinder-piston assembly 85.

Suitable hydraulic connections (not shown) to a controller (not shown) and to a source of pressure fluid (not shown) can be provided so as selectively to extend the cylinder-piston assembly 85 and thereby tilt upwardly the swivel bracket 43 and connected propulsion unit 13 above the horizontal axis 55 and so as to retract the cylinder-piston assembly 85 and thereby downwardly displace the swivel bracket 43 and connected propulsion unit 13 about the horizontal axis 55.

Means 91 are provided for receiving side loading from the swivel bracket 43 for transmission to the boat transom 19. While various arrangements can be employed, in the illustrated construction, such means comprises formation of the transom bracket means 41 with a pair of laterally spaced, rearwardly extending arms or brackets 95 which extend to opposite sides of the lower end 99 of the swivel bracket 43 and which preferably respectively include flat load receiving inner surfaces 97. The lower end 49 of the swivel bracket 43 is provided, on each side, with respective flat, load transmitting surfaces 99 adapted to engage the inner surfaces 97 of the brackets 95 for transmission thereto, and to the transom 19, of side loading occurring, as for instance, during steering.

The brackets 95 extend rearwardly for engagement with the load transmitting surfaces 99 for a distance sufficient to accommodate side loading through a lower or trim range of the permissible vertical tilting movement of the swivel bracket 43. In addition, the brackets 95 are laterally spaced slightly more than the distance between the load transmitting surfaces 99 of the swivel bracket 43 so as to afford unrestrained upward tilting movement of the swivel bracket 43 and propulsion unit 13 in the absence of side loading.

Various of the features of the invention are set forth in the following claims.

I claim:

1. A marine propulsion device comprising transom bracket means adapted to be fixed to a boat transom, a swivel bracket including a vertical leg having upper and lower ends, and a pair of arms extending upwardly in laterally spaced relation from said upper end of said swivel bracket vertical leg and in rearward relation to the boat transom, said pair of arms including respective upper ends, first pivot means connecting said upper ends of said arms and said transom bracket means for vertical swinging of said swivel bracket relative to said transom bracket means about a first axis which is fixed relative to said transom bracket means and which is horizontal when said transom bracket means is boat mounted, a propulsion unit including a powerhead and a lower unit fixedly connected to said powerhead and including, at the lower end thereof, a propeller, and second pivot means connecting said propulsion unit and said swivel bracket vertical leg for movement of said propulsion unit in common with said swivel bracket about said first axis and for steering movement of said propulsion unit relative to said swivel bracket about an axis which extends transversely to said first axis.

2. A marine propulsion device in accordance with claim 1 and further including means connected to said transom bracket means and to said lower end of said swivel bracket for selectively displacing said swivel bracket about said first axis.

3. A marine propulsion device in accordance with claim 2 wherein said means for selectively displacing said swivel bracket comprises a hydraulic cylinder-piston assembly.

4. A marine propulsion device in accordance with claim 3 wherein said cylinder-piston assembly extends principally horizontally when said swivel bracket and propulsion unit are in normal operating position.

5. A marine propulsion device in accordance with claim 1 and further including means on said transom bracket means and on said lower end of said swivel bracket for providing lateral support thereto under side loading, while permitting unrestrained pivotal movement of said swivel bracket about said first axis in the absence of side loading.

6. A marine propulsion device in accordance with claim 5 wherein said means for providing lateral support comprises a laterally spaced pair of rearwardly extending legs positioned to receive therebetween said swivel bracket lower end.

7. A marine propulsion device in accordance with claim 6 wherein said legs include inner flat load receiving surfaces and wherein said lower end of said swivel bracket includes flat load transmitting surfaces adapted for engagement with said load receiving surfaces.

8. A marine propulsion device in accordance with claim 1 wherein said second pivot means connects said vertical leg of said swivel bracket and said lower unit.

9. A marine propulsion device in accordance with claim 1 wherein said first pivot means is located rearwardly of the boat transom.

10. A marine propulsion device comprising transom bracket means adapted to be fixed to a boat transom, a swivel bracket including a vertical leg having upper and lower ends, and a pair of arms extending upwardly in laterally spaced relation from said upper end of said swivel bracket vertical leg and including respective upper ends, first pivot means connecting said upper ends of said arms and said transom bracket means for vertical swinging of said swivel bracket relative to said transom bracket means about a first axis which is horizontal when said transom bracket means is boat mounted, a propulsion unit including a powerhead having a top, and a lower unit fixedly connected to said powerhead and including, at the lower end thereof, a propeller, and second pivot means connecting said propulsion unit and said swivel bracket vertical leg for movement of said propulsion unit in common with said swivel bracket about said first axis and for steering movement of said propulsion unit relative to said swivel bracket about an axis which extends transversely to said first axis, and such that said powerhead top does not extend substantially above said first axis when said propulsion unit is in a normal running position.

11. A marine propulsion device comprising transom bracket means adapted to be fixed to a boat transom, a swivel bracket including a vertical leg having upper and lower ends, and a pair of arms extending upwardly in laterally spaced relation from said upper end of said swivel bracket vertical leg and including respective upper ends, first pivot means connecting said upper ends of said arms and said transom bracket means for vertical swinging of said swivel bracket relative to said transom bracket means about a first axis which is horizontal when said transom bracket means is boat mounted, a propulsion unit including a powerhead extending between said arms of said swivel bracket, and a lower unit fixedly connected to said powerhead and including, at the lower end thereof, a propeller, and second pivot means connecting said propulsion unit and said swivel bracket vertical leg for movement of said propulsion unit in common with said swivel bracket about said first axis and for steering movement of said propulsion unit relative to said swivel bracket about an axis which extends transversely to said first axis.

12. A marine propulsion device comprising transom bracket means adapted to be fixed to a boat transom, a swivel bracket including a vertical leg having upper and lower ends, and a pair of arms extending upwardly in laterally spaced relation from said upper end of said swivel bracket vertical leg and including respective upper ends, first pivot means connecting said upper ends of said arms and said transom bracket means for vertical swinging of said swivel bracket relative to said transom bracket means about a first axis which is horizontal when said transom bracket means is boat mounted, a propulsion unit including a powerhead and a lower unit fixedly connected to said powerhead and including, at the lower end thereof, a propeller, and second pivot means connecting said propulsion unit and said swivel bracket vertical leg for movement of said propulsion unit in common with said swivel bracket about said first axis and so as to locate said propulsion unit, when in a fully tilted position, substantially wholly rearwardly of the boat transom, and for steering movement of said propulsion unit relative to said swivel bracket about an axis which extends transversely to said first axis.

13. A marine propulsion device in accordance with any one of claims 10, 11 or 12 and further including means connected to said transom bracket means and to said lower end of said swivel bracket for selectively displacing said swivel bracket about said first axis.

14. A marine propulsion device in accordance with claim 13 wherein said means for selectively displacing said swivel bracket comprises a hydraulic cylinder-piston assembly.

15. A marine propulsion device in accordance with claim 14 wherein said cylinder-piston assembly extends principally horizontally when said swivel bracket and propulsion unit are in normal operating position.

16. A marine propulsion device in accordance with any one of claims 10, 11, or 12 and further including means on said transom bracket means and on said lower end of said swivel bracket for providing lateral support thereto under side loading, while permitting unrestrained pivotal movement of said swivel bracket about said first axis in the absence of side loading.

17. A marine propulsion device in accordance with claim 16 wherein said means for providing lateral support comprises a laterally spaced pair of rearwardly extending legs positioned to receive therebetween said swivel bracket lower end.

18. A marine propulsion device in accordance with claim 17 wherein said legs include inner flat load receiving surfaces and wherein said lower end of said swivel bracket includes flat load transmitting surfaces adapted for engagement with said load receiving surfaces.

19. A marine propulsion device in accordance with any one of claims 10, 11, or 12 wherein said second pivot means connects said vertical leg of said swivel bracket and said lower unit.

20. A marine propulsion device in accordance with any one of claims 10, 11, or 12 wherein said first pivot means is located rearwardly of the boat transom.

21. A marine propulsion device in accordance with any one of claims 11 or 12 wherein said powerhead includes a top and wherein said horizontal axis is located at least as high as adjacent to the top of said powerhead.

22. A marine propulsion device in accordance with any one of claims 10 or 12 wherein said powerhead extends between said arms of said swivel bracket.

23. A marine propulsion device in accordance with any one of claims 10 or 11 wherein said propulsion unit is located, when in a fully tilted position, substantially wholly rearwardly of the boat transom.

24. A marine propulsion device comprising transom bracket means adapted to be fixed to a boat transom, a swivel bracket including a vertical leg having upper and lower ends, and a pair of arms extending upwardly in laterally spaced relation from said upper end of said swivel bracket vertical leg and including respective upper ends, first pivot means connecting said upper ends of said arms and said transom bracket means for vertical swinging of said swivel bracket relative to said transom bracket means about a first axis which is horizontal when said transom bracket means is boat mounted, a propulsion unit including a powerhead and a lower unit fixedly connected to said powerhead and including, at the lower end thereof, a propeller, and second pivot means located substantially below said first pivot means and connecting said propulsion unit and said swivel bracket vertical leg for movement of said propulsion unit in common with said swivel bracket about said first axis and for steering movement of said propulsion unit relative to said swivel bracket about an axis which extends transversely to said first axis.

25. A marine propulsion device comprising transom bracket means adapted to be fixed to a boat transom, a swivel bracket including a vertical leg having upper and lower ends, and a pair of arms extending upwardly in laterally spaced relation from said upper end of said swivel bracket vertical leg and including respective upper ends, first pivot means connecting said upper ends of said arms and said transom bracket means for vertical swinging of said swivel bracket relative to said transom bracket means about a first axis which is fixed relative to said transom bracket means and which is horizontal when said transom bracket means is boat mounted, a propulsion unit including a powerhead and a lower unit fixedly connected to said powerhead and including, at the lower end thereof, a propeller, and second pivot means located substantially below said first pivot means and connecting said propulsion unit and said swivel bracket vertical leg for movement of said propulsion unit in common with said swivel bracket about said first axis and for steering movement of said propulsion unit relative to said swivel bracket about an axis which extends transversely to said first axis.

* * * * *